US007097749B2

(12) United States Patent
Donovan, III et al.

(10) Patent No.: US 7,097,749 B2
(45) Date of Patent: Aug. 29, 2006

(54) PLATING RACK WITH ROTATABLE INSERT

(75) Inventors: Lawrence P. Donovan, III, Lowell, MI (US); David P. Hartrick, Lowell, MI (US); John A. Piselli, Ionia, MI (US); Brian Ellison, Lowell, MI (US)

(73) Assignee: Lacks Enterprises, Inc., Grand Rapids, MI (US)

( * ) Notice: Subject to any disclaimer, the term of this patent is extended or adjusted under 35 U.S.C. 154(b) by 649 days.

(21) Appl. No.: 10/266,884

(22) Filed: Oct. 8, 2002

(65) Prior Publication Data

US 2004/0065557 A1 Apr. 8, 2004

(51) Int. Cl.
*C25D 17/08* (2006.01)

(52) U.S. Cl. ..... 204/297.07; 204/297.09

(58) Field of Classification Search ..... None
See application file for complete search history.

(56) References Cited

U.S. PATENT DOCUMENTS 2,165,562 A * 7/1939 Mack et al. ..... 206/223
2,362,474 A * 11/1944 Elsenheimer ..... 204/297.04
3,901,788 A * 8/1975 Schaer ..... 204/297.04
3,923,631 A 12/1975 Palisin, Jr.
3,964,987 A * 6/1976 Reppert et al. ..... 204/297.13
3,972,785 A 8/1976 Palisin, Jr.
3,972,798 A 8/1976 Palisin, Jr.
4,097,359 A * 6/1978 Davitz ..... 204/297.06
4,540,478 A 9/1985 Mallok et al.
4,595,480 A 6/1986 Takiar et al.
4,988,426 A 1/1991 Metzka
5,401,370 A 3/1995 Kauper et al.
5,759,363 A 6/1998 Rose
6,071,385 A 6/2000 Long
6,299,745 B1 10/2001 Kumar et al.

* cited by examiner

*Primary Examiner*—Harry D. Wilkins, III

(57) ABSTRACT

A processing rack, such as for electroplating, which minimizes shelf areas of an article during processing of the article and during removal of the article from a processing bath and which allows easy mounting of articles on the rack and demounting of articles from the rack includes a frame and a plurality of article mounting fixtures that are each pivotally mounted on the frame and independently pivotable from a first orientation that facilitates mounting and/or demounting of articles, to a second orientation that is most conducive to producing high quality, substantially defect-free plating.

11 Claims, 3 Drawing Sheets

PLATING RACK WITH ROTATABLE INSERT

FIELD OF THE INVENTION

This invention relates to a racks for supporting articles during processing of the articles while immersed in a processing bath.

BACKGROUND OF THE INVENTION

During processing of articles immersed in an electroplating bath, particulate materials may settle on horizontal flat and concave surfaces, referred to as shelf areas. These particles can interfere with the electroplating process and cause roughness in the deposit and visible imperfections that detract from the aesthetic qualities and/or functional qualities of the electroplated article. Also, gas generated at electrodes can accumulate on downwardly facing horizontal flat and concave surfaces. This accumulation of gas may also cause defects. Further, electrolyte solution from the electroplating bath can be carried from the bath by shelf areas of the processed article when the rack carrying the article is removed from the bath. This electrolyte drag-out is undesirable because it depletes the electrolyte in the electroplating bath and wastes process solution.

Accordingly, it is desirable to eliminate or at least minimize shelf areas of an article during electroplating of the article and during removal of the article from the electroplating bath. It is especially desirable to arrange the article in an orientation during electroplating that eliminates or at least minimizes shelf areas of the article that are normally visible during use of the article.

A relatively obvious solution to the problems associated with electroplating articles having shelf areas is to provide an electroplating rack designed to support the articles in an orientation that minimizes shelf areas, especially shelf areas that are visible during normal use of the article. However, in the case of certain articles, such as plastic wheel covers, mounting of the articles on the rack and demounting of the articles from the rack in a most preferred orientation for electroplating can be difficult and time consuming. For example, the preferred orientation of a plastic wheel cover, such as for an automobile, during electroplating is one in which the concave outwardly facing rim surfaces that are visible during normal use of a vehicle are facing downwardly to prevent particulate matter from settling on these normally visible concave surfaces and to prevent drag-out of the electrolyte during removal of the electroplating rack supporting the wheel cover. However, a cylindrical electrode is typically positioned with its axis generally aligned with the central axis of the wheel cover so that the outer cylinder walls are substantially adjacent the normally visible outwardly facing concave rim surfaces of the wheel cover to facilitate production of a uniform, imperfection-free plating on these surfaces. As a result, it is necessary to first mount the wheel cover on the electroplating rack, and then mount the electrode in the recessed hub of the wheel cover. Mounting of the wheel cover in an appropriate inverted orientation, and subsequent mounting of an electrode within the downwardly facing hub recess is difficult and requires substantially more time than mounting the wheel cover in a more conventional orientation in which the central axis of the hub is aligned horizontally, especially when a plurality of vertically closely spaced apart wheel covers are mounted together on a single rack. Similarly, the most desirable orientation for demounting wheel covers from an electroplating rack is with the central axis of the wheel cover aligned horizontally.

Therefore, the most desirable orientation for mounting articles on, and/or demounting articles from, an electroplating rack is not always the same orientation that is most desirable for electroplating the article.

SUMMARY OF THE INVENTION

The invention overcomes problems with known processing racks by providing a rack with a plurality of article mounting fixtures that are each pivotally mounted on a frame and independently pivotable from a first orientation to a second orientation.

In accordance with one aspect of the invention, there is provided an electroplating rack having a frame and a plurality of article mounting fixtures that are each pivotally mounted on the frame and independently pivotable from a first orientation that facilitates mounting and/or demounting of articles, to a second orientation that is most conducive to production of high quality, substantially defect-free plating.

In another aspect of the invention, there is provided an electroplating process including steps of providing an electroplating rack with a plurality of article mounting fixtures that are each pivotally mounted on a frame and independently pivotable from a first orientation to a second orientation; mounting articles onto the article mounting fixtures while the article mounting fixtures are in a first orientation; pivoting the article mounting fixtures carrying the articles into a second orientation; immersing the rack carrying the articles in an electroplating bath; and electroplating the articles while the article mounting fixtures are in the second orientation.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
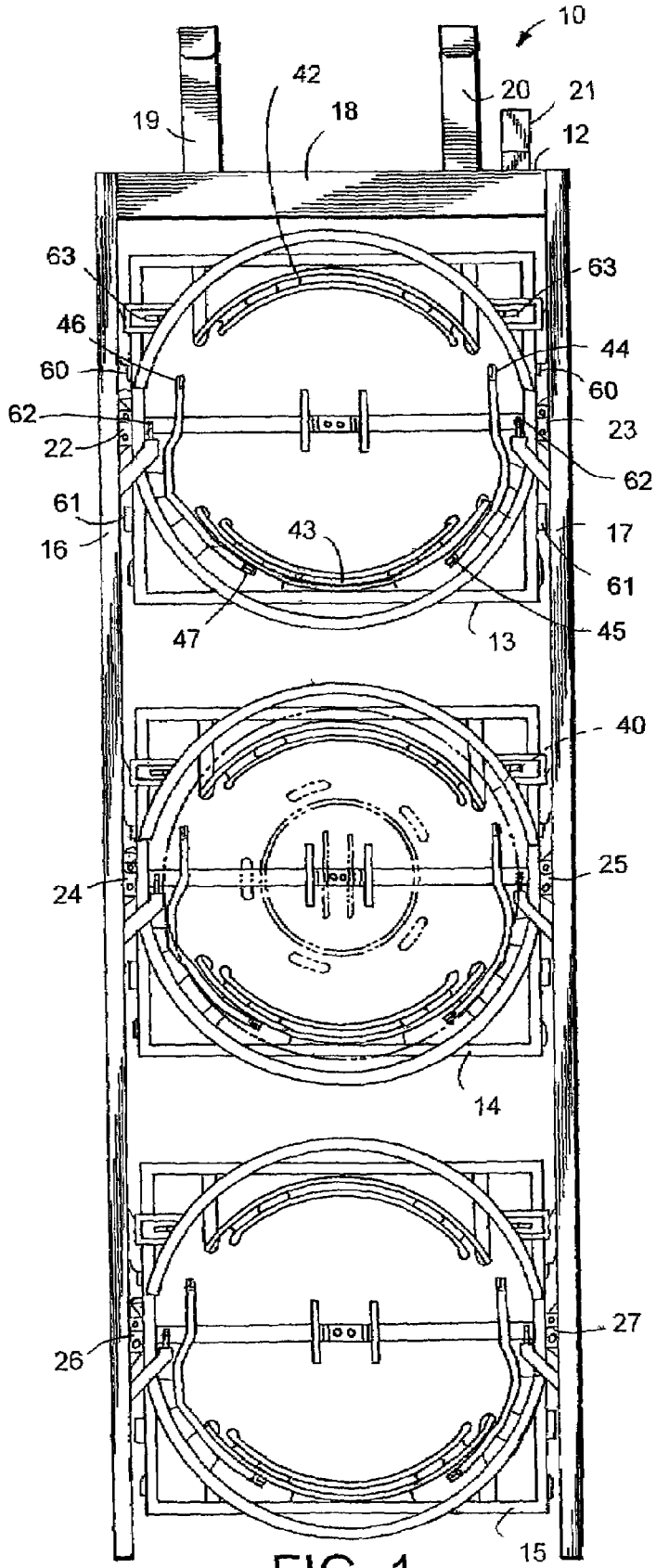
FIG. 1 is a front elevational view of an electroplating rack in accordance with the invention, with pivotable article mounting fixtures in a first orientation that facilitates easy mounting of articles on the rack and easy demounting of articles from the rack.

In FIG. 1 there is shown an electroplating rack 10 comprising a main frame 12 and a plurality of independently pivotable article mounting fixtures 13, 14 and 15. Frame 12 has an electrically conductive framework including a pair of uprights 16 and 17, and an upper tie bar 18. A pair of hooks 19 and 20 are provided to support frame 12 from a bus bar of an automatic plating apparatus. Hooks 19 and/or 20 also conduct electricity from the bus bar to the part being electroplated. An electrical connector 21 is also provided to conduct electricity from an auxiliary bus bar to an auxiliary anode (described below).

Uprights 16 and 17 extend from tie bar 18 and extend in parallel vertical relationship. A plurality of pivot joints 22, 23, 24, 25, 26 and 27 are provided on uprights 16 and 17 to support article mounting fixtures 13, 14 and 15 for independent pivotal movement with respect to frame 12. Pivot joints 22, 23, 24, 25, 26 and 27 may be configured to facilitate easy removal or detachability of fixtures 13, 14 and 15 without requiring disassembly of the pivot joints or the fixtures. Alternatively, pivot joints 22, 23, 24, 25, 26 and 27 may be configured so that axles 30, 31, 32, 33, 34 and 35 of fixtures 13, 14 and 15 are permanently journaled within pivot joints 22, 23, 24, 25, 26 and 27, respectively.

Figure 2:
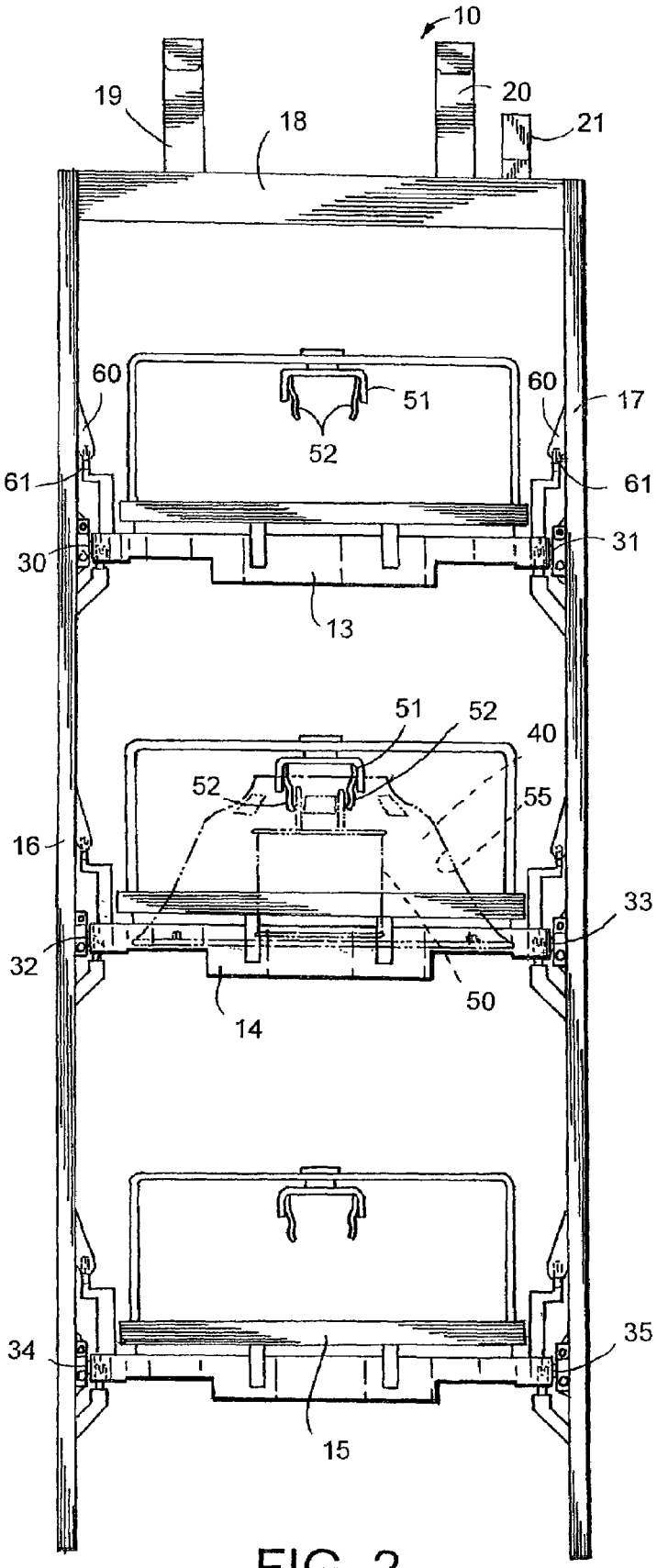
FIG. 2 is front elevational view of the rack shown in FIG. 1, with the pivotable article mounting fixtures in a second orientation that is most conducive to production of high quality, defect-free plating.

Electroplating rack 10 is designed to allow mounting of parts, such as wheel cover 40 (shown in dashed lines in FIGS. 1 and 2), in a first orientation wherein the central axis of part 40 is aligned horizontally (shown in FIG. 1), and subsequent rotating or pivoting of fixtures 13, 14 and 15 approximately 90 degrees to a second orientation wherein the central axis of wheel well 40 is aligned vertically (as shown in FIG. 2). Wheel covers 40 can be more easily mounted on fixtures 13, 14 and 15 when fixtures 13, 14 and 15 are orientated as shown in FIG. 1. More specifically, wheel covers 40 are manually orientated so that the central axis of the wheel cover is aligned horizontally, and so that features on the backside (i.e., the side opposite the surfaces of the wheel cover which are displayed during normal use) are adjacent shields 42 and 43, which are present to minimize electrodeposition on resilient snap tabs (not shown). Wheel cover 40 is then inserted onto a fixture 13, 14 or 15 so that electrical connections 44, 45, 46 and 47 engage part (wheel cover) 40. Thereafter, a cylinder shaped auxiliary anode 50 (shown in dashed lines in FIGS. 2 and 3) is centrally disposed within a recessed space adjacent surfaces 55 of wheel cover 40, which are displayed during normal use of wheel cover 40 on a vehicle. Auxiliary anode 50 is retained by an electrode holder 51 having resiliently deformable (spring-like) electrode retainers 52. Electrode retainers 52 are electrically conductive and serve the dual function of retaining auxiliary anode 50 and conducting electrical current to auxiliary anode 50 during the electroplating process. Desirably, auxiliary anode 50 is relatively inert, i.e., does not appreciably react or decompose in the plating bath, and only serves to impart an electrical potential between the auxiliary anode 50 and the part 40 to help achieve uniform electroplating on surfaces of the part 40 that are remote from the primary or bath anode (not shown).

As is relatively apparent, mounting of wheel covers 40 and electrodes 50 onto fixtures 13, 14 and 15 can be achieved more easily and in less time when the independently pivotable article mounting fixtures 13, 14 and 15 are oriented as shown in FIG. 1, then when fixtures 13, 14 and 15 are oriented as shown in FIG. 2 (the orientation best suited for uniform, defect-free electroplating). After wheel covers 40 and electrodes 50 have been properly mounted on fixtures 13, 14 and 15 with the fixtures in the orientation shown in FIG. 1, fixtures 13, 14 and 15 are rotated 90 degrees into the orientation shown in FIG. 2 prior to inserting rack 10 into an electroplating bath.

Figure 3:
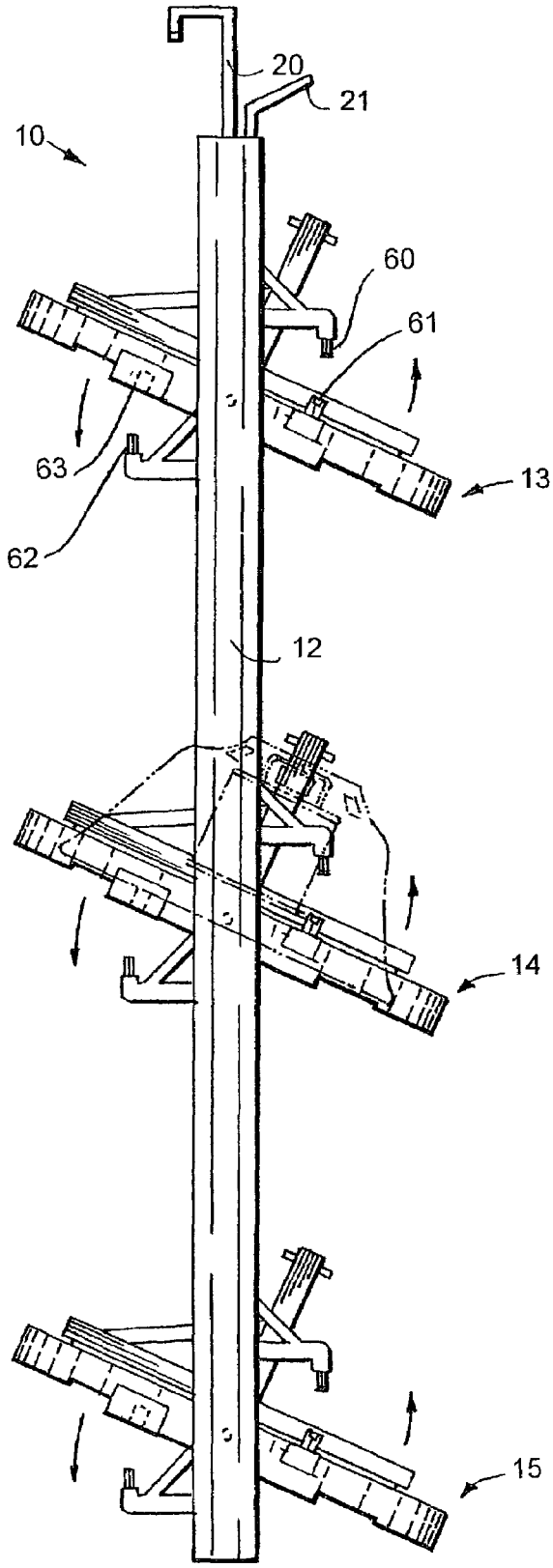
FIG. 3 is a side elevational view of the rack shown in FIGS. 1 and 2, with the pivotable article mounting fixtures in an orientation intermediate between the preferred mounting orientation and the preferred electroplating orientation.

As can be seen by reference to FIG. 3, as fixtures 13, 14 and 15 are rotated into the proper position for electroplating, electrical connections are made between electrical contacts 60 and 61 to conduct electricity to wheel covers 40, and between electrical contacts 62 and 63 to conduct electricity to auxiliary anodes 50, during the electroplating process. Contacts 60, 61, 62 and 63 utilize a plug and socket type connection to minimize direct contact between non-electrode electrical conductors and the electrolyte in the electroplating bath to minimize corrosion of the electroplating rack components. As is well known in the art, the components of electroplating rack 10 are substantially covered with an electrical insulating material, whereby electrolytic reactions are substantially limited to the electrodes and the surfaces of the wheel cover.

While the invention has been described with respect to a specific embodiment, the essential characteristics of the invention (i.e., the use of particle mounting fixtures that can be independently rotatable or pivotable on a rack frame) may in certain circumstances be advantageously employed in other processes, such as in etching processes, chemical or physical deposition processes, etc.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A rack for supporting articles during processing of the articles, comprising:

a frame; and a plurality of article mounting fixtures that are each pivotally mounted on a frame and independently pivotable from a first orientation to a second orientation, wherein electrical contacts are provided on the frame and on the article mounting fixtures, the electrical contacts being configured to achieve an electrical connection in one of the first or second orientations, and an electrical disconnection in the other orientation.

2. The processing rack of claim 1, wherein the article mounting fixtures include axles received in pivot joints on the frame.

3. The processing rank of claim 2, wherein the pivot joints are configured to releasably receive the axles of the article mounting fixtures whereby the article mounting fixtures are removable without disassembly of the pivot joints or article mounting fixtures.

4. The processing rack of claim 2, wherein the pivot joints are configured so that the axles of the article mounting fixtures are permanently journaled in the pivot joints.

5. The processing rack of claim 1, wherein each of the plurality of article mounting fixtures includes an auxiliary anode holder having resiliently deformable anode retainers.

6. The processing rack of claim 1, wherein the electrical connections and disconnection are achieved by engagement and disengagement respectively of plug and socket type connectors.

7. An electroplating rack comprising; a frame; and a plurality of article mounting fixtures that are each pivotally mounted on the frame and independently pivotable from a first orientation that facilitates mounting and/or demounting of articles, to a second orientation that is conducive to production of high quality, substantially defect-free electroplating, wherein electrical contacts are provided on the frame and on the article mounting fixtures, the electrical contacts being configured to achieve an electrical connection in one of the first or second orientations, and an electrical disconnection in the other orientation.

8. The electroplating rack of claim 7, wherein the article mounting fixtures include axles received in pivot joints on the frame.

9. The electroplating rack of claim 8, wherein the pivot joints are configured to releasably receive the axles of the article mounting fixtures whereby the article mounting fixtures are removable without disassembly of the pivot joints or article mounting fixtures.

10. The electroplating rack of claim 8, wherein the pivot joints are configured so that the axles of the article mounting fixtures are permanently journaled in the pivot joints.

11. The processing rack of claim 7, wherein the electrical connections and disconnection are achieved by engagement and disengagement respectively of plug and socket type connectors.

* * * * *

UNITED STATES PATENT AND TRADEMARK OFFICE

CERTIFICATE OF CORRECTION

PATENT NO. : 7,097,749 B2
APPLICATION NO. : 10/266884
DATED : August 29, 2006
INVENTOR(S) : Lawrence P. Donovan, III et al.

It is certified that error appears in the above-identified patent and that said Letters Patent is hereby corrected as shown below:

Column 4:
Claim 3, Line 37, “rank” should be --rack--.

Signed and Sealed this

Twenty-seventh Day of February, 2007

JON W. DUDAS
*Director of the United States Patent and Trademark Office*